US007051650B2

(12) United States Patent
Kusakari et al.

(10) Patent No.: US 7,051,650 B2
(45) Date of Patent: May 30, 2006

(54) STRANDED WIRE TWISTING DEVICE OF REINFORCEMENT BINDING MACHINE

(75) Inventors: Ichiro Kusakari, Tokyo (JP); Takahiro Nagaoka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 55 days.

(21) Appl. No.: 10/493,828

(22) PCT Filed: Oct. 24, 2002

(86) PCT No.: PCT/JP02/11059

§ 371 (c)(1),
(2), (4) Date: Apr. 28, 2004

(87) PCT Pub. No.: WO03/037545

PCT Pub. Date: May 8, 2003

(65) Prior Publication Data

US 2005/0005992 A1 Jan. 13, 2005

(30) Foreign Application Priority Data

Oct. 29, 2001 (JP) ..... 2001-330713

(51) Int. Cl.
*B65B 13/28* (2006.01)
*B21F 15/04* (2006.01)

(52) U.S. Cl. ..... 100/31; 140/93.6; 140/119

(58) Field of Classification Search ..... 100/26, 100/31; 140/93 A, 93.6, 119; 53/138.6, 53/138.8

See application file for complete search history.

(56) References Cited

U.S. PATENT DOCUMENTS

| | | | | |
|---|---|---|---|---|
| 2,214,267 | A * | 9/1940 | Bednarek | 140/119 |
| 5,871,036 | A * | 2/1999 | Murayama et al. | 140/119 |
| 5,983,473 | A * | 11/1999 | Yuguchi et al. | 29/33 F |
| 6,041,833 | A * | 3/2000 | Suric | 140/119 |

FOREIGN PATENT DOCUMENTS

| | | |
|---|---|---|
| EP | 731238 A1 | 9/1996 |
| JP | A-60-033982 | 2/1985 |
| JP | 7-275983 | 10/1995 |
| WO | WO97/34065 | 9/1997 |

* cited by examiner

*Primary Examiner*—Derris H. Banks
*Assistant Examiner*—Jimmy T. Nguyen
(74) *Attorney, Agent, or Firm*—Morgan, Lewis & Bockius LLP

(57) ABSTRACT

A twisting shaft 33 and a remover 34 fitted around the twisting shaft 33 are provided with forks 37, 44 at their respective front portions, and hooks 38 bent from front ends of the forks of the twisting shaft in the forward rotational direction are provided. The remover is rotatable by a one-way stopper mechanism in the forward direction only. When the twisting shaft and remover are rotated forward, a binding wire loop is hung on the hooks 38 and twisted. When the twisting shaft is reversely rotated after the completion of the twisting operation, the remover stops being rotated by the one-way stopper mechanism, and the twisting shaft alone is reversely rotated. As a result, the hooks 38 hide themselves behind the forks 44 of the remover 34, and the binding wire engaged with the hooks 38 is pressed by the forks 44 and removed.

11 Claims, 7 Drawing Sheets

STRANDED WIRE TWISTING DEVICE OF REINFORCEMENT BINDING MACHINE

TECHNICAL FIELD

This invention relates to an apparatus for twisting a binding wire, such as a metal wire for reinforcing bar binding machines, and more particularly to a binding wire twisting apparatus of a simplified structure for reinforcing bar binding machines.

BACKGROUND ART

An example of a related art apparatus of this kind will now be described with reference to drawings. FIG. 7 shows a related art reinforcing bar binding machine 1, in which a housing 2 contains therein a binding wire feed unit 3 and a binding wire twisting apparatus 4, a reel base (not shown) being fixed to a rear side surface (rear side of the drawing) of the housing 2, a binding wire reel being mounted on the reel base. A feed roller 5 of the binding wire feed unit 3 is driven by a motor (not shown), and supplies the binding wire wound around a reel therefor to a nose 7, which is formed ahead thereof, through a guide pipe 6. The binding wire twisting apparatus 4 is a unit for tightening the binding wire W wound around reinforcing bar R by the binding wire feed unit 3, by gripping and twisting the binding wire W, and adapted to rotate in the forward and rearward directions a screw shaft 10 connected to reduction gears 9 driven by a motor 8.

As shown in FIG. 8(*a*), a shaft with a slot 11 is connected rotatably to a front end of the screw shaft 10 by a flanged pin 12 and a slip-off preventing C-ring 13, and the shaft 11 is provided at a front end portion of a slot 11*a* with a guide pin 14 extending at right angles to the axis thereof. The screw shaft 10 is provided with a sleeve 15, and a sleeve 16 fitted around an outer circumference of the sleeve 15. A ball (not shown) inserted in a hole of the sleeve 15 is engaged with the screw shaft 10, and retained in the hole as the ball is held by the sleeve 16. The sleeve 15 and sleeve 16 are combined with each other, and moved together forward or rearward in accordance with the rotation of the screw. Further, fins 17 are arranged radially on an outer circumferential surface of a rear portion of the sleeve 2.

A pair of hook levers 18 are fixed symmetrically on the opposite sides of the shaft 11 to the front end portion of the slot 16*a* which is provided at a front portion of the sleeve 16, and a guide recess 18*a* in an inner portion of the hook levers 18 is engaged with the guide pin 14 of the shaft 11. Hooks 18*b* at front ends of the two hook levers 18 are expanded and face in the forward direction when the hooks are on standby. When the sleeves 15, 16 are slid forward on the shaft 11, a support shaft of the hook levers 18 is moved forward, and the guide pin 14 is stopped, so that the front ends of the hook levers 18 are closed. Concerning the binding wire twisting apparatus 4, a position in which the sleeves 15, 16 taking the positions shown in the drawing are turned at 90° to cause the hook levers 18 to become horizontal is a standby position, in which a binding wire loop W is gripped from the left and right sides thereof.

The binding wire feed unit 3 and binding wire twisting apparatus 4 are sequence-controlled by a control circuit (not shown), and execute a one-cycle operation including a binding wire feed step and a binding wire twisting step by pulling a trigger lever 19 provided in a grip portion 2*a* shown in FIG. 7. When the trigger lever 19 is pulled, a binding wire feed motor (not shown) is started, and the binding wire W fed out to the nose 7 by the rotation of the feed roller 5 is bent arcuately along a guide groove in an inner circumference of the nose 7, and wound around a circumference of the reinforcing bar R. When the binding wire finishes being wound a predetermined number of turns around the reinforcing bar, the binding wire feed motor is stopped, and the motor 8 in the binding wire twisting apparatus 4 is then started.

In a standby position shown in FIG. 8(*a*), a rotation stopping projection 20 provided in the housing is engaged with the fins 17 of the sleeve 16, so that the sleeves 15, 16 and shaft 11 are in a non-rotatable condition. When the screw shaft 10 is rotated counter-clockwise in side elevation taken from the motor side (right side in the drawing), the sleeves 15, 16 are moved forward together, and the hook levers 18 are closed as shown in FIG. 8(*b*), to grip the binding wire loop. During this time, the fins 17 of the sleeve 16 are disengaged from the rotation-stopping projection 20, and the sleeves 15, 16 and shaft 11 are rotated with the screw shaft 10. As a result, the hook levers 18 twist the binding wire loop, and the reinforcing bars are thereby bound together.

A binding wire cutting unit 21 provided in a path of the binding wire in the nose 7 shown in FIG. 7 is then driven to cut the binding wire in the nose 7, and the motor 8 is rotated reversely at the same time to cause the sleeves 15, 16 to be moved back. The hook levers 18 are then opened to release the binding wire, and the binding wire twisting apparatus 4 returns to a standby condition.

DISCLOSURE OF THE INVENTION

The related art binding wire twisting apparatus for reinforcing bar binding machines is formed by a ball screw mechanism including a screw shaft, sleeves and balls, and hook levers and the like for executing a binding wire gripping operation and a binding wire twisting operation, so that the number of parts is large. Since the sleeves and hook levers are moved longitudinally on the screw shaft, a total length of the apparatus is correspondingly large and a space occupied thereby is large. This causes technical problems to be solved for the purpose of simplifying the construction of the binding wire twisting apparatus, reducing the number of the parts thereof, and miniaturizing the apparatus to arise. The present invention aims at solving these problems.

The present invention has been proposed so as to attain this object, and provides a binding wire twisting apparatus for reinforcing bar binding machines, adapted to feed a binding wire along a loop guide by a binding wire feed unit and thereby form a binding wire loop, and twist the binding wire loop by binding wire twisting apparatus and thereby bind reinforcing bar therewith; and having a structure in which forks are formed at front portions of a shaft and a sleeve which form a rotary pair, the forks of one of the shaft and sleeve being provided with hooks bent from a front end thereof in the forward rotational direction, the binding wire loop being hung on the hooks and twisted by rotating the shaft and sleeve forward, the shaft or sleeve on which the hooks are provided being rotated relatively reversely after the completion of the twisting operation to thereby cause the binding wire engaged with the hooks to be removed.

Figure 1:
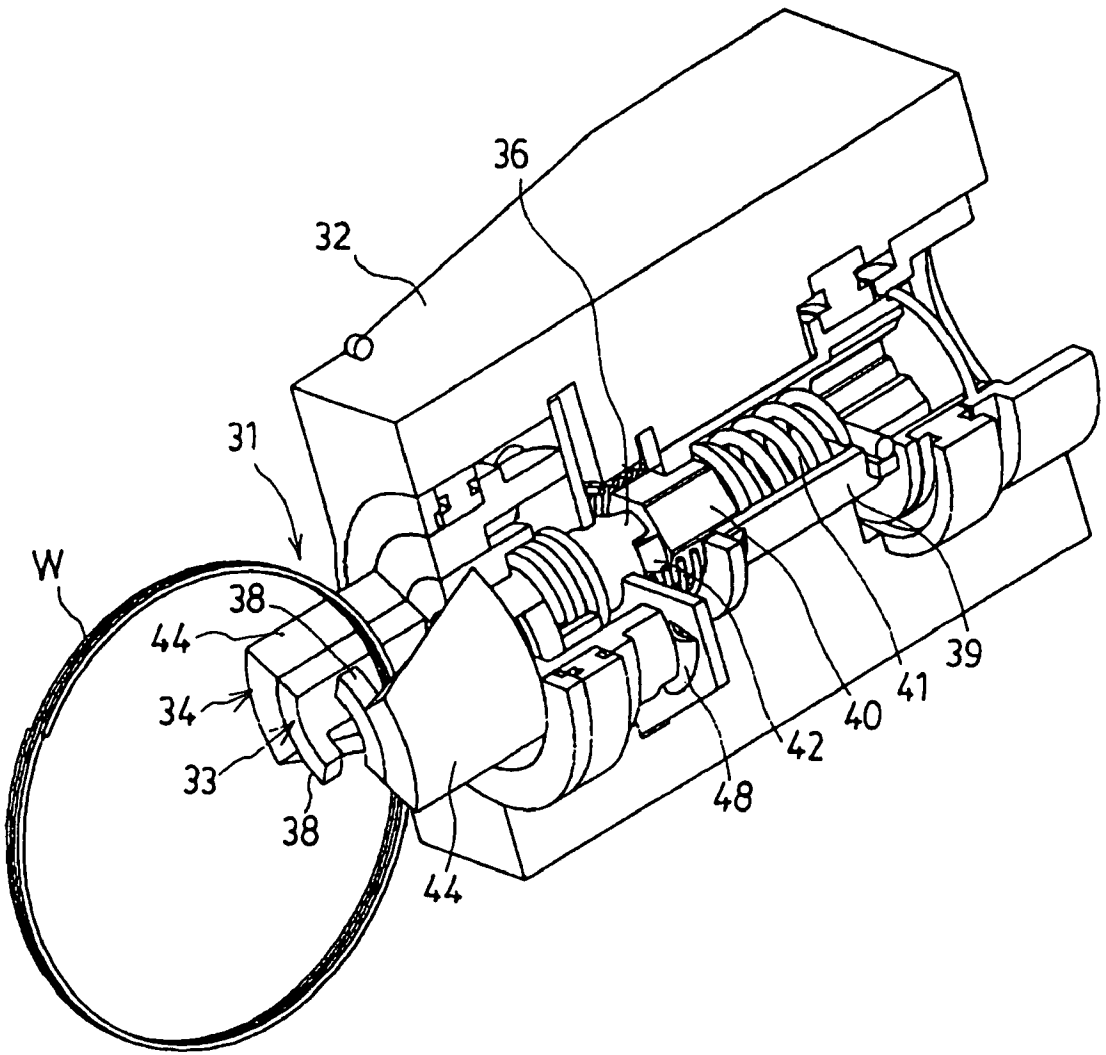
FIG. 1 shows a mode of embodiment of the present invention, and is a partially cutaway view in perspective of a binding wire twisting apparatus for reinforcing bar binding machines.

Referring to the drawings, a reference numeral 31 denotes a binding wire twisting apparatus, 32 a bearing, 33 a twisting shaft, 34 a remover (sleeve), 35 a shaft portion, 36 a clutch claw, 37 forks, 38 hooks, 39 a driving shaft, 40 a clutch shaft, 41 a compression coiled spring, 42 a clutch claw, 43 a cylindrical shaft, 44 forks, 45 flanges, 46 recesses, 47 a ratchet, and 48 a one-way stopper claw.

BEST MODE FOR CARRYING OUT THE INVENTION

Figure 2:
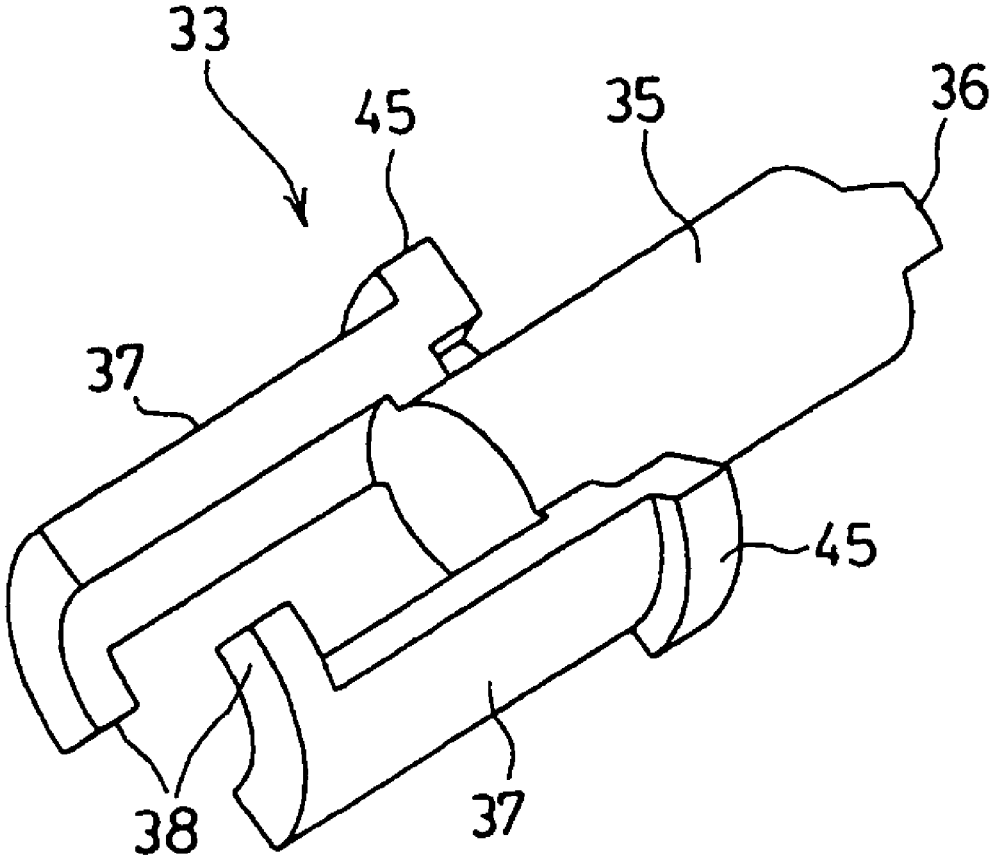
FIG. 2 is a perspective view of a twisting shaft.

A mode of embodiment of this invention will now be described in detail with reference to the drawings. FIG. 1 shows a binding wire twisting apparatus 31 for reinforcing bar binding machines, and a reference numeral 32 denotes a bearing of a reinforcing bar binding machine, in which the bearing 32 of the binding wire twisting apparatus 31 is fitted. The binding wire twisting apparatus 31 is provided with a twisting shaft 33 connected to reduction gears of a twisting motor, and a sleeve (which will hereinafter be referred to as a remover 34) fitted around the twisting shaft 33. FIG. 2 shows a twisting shaft 33, and clutch claw 36 is formed at a rear end section of a shaft portion 35. A pair of forks 37 project forward from an outer circumferential surface of the shaft portion 35. Hooks 38 are provided to extend from front ends of the forks 37 and bent in the circumferential direction of the shaft, i.e., counter-clockwise in front view thereof. The outer surfaces of the forks 37 and hooks 38 are made cylindrical so that the forks 37 and hooks 38 can be inserted into the interior of the remover 34.

Figure 3:
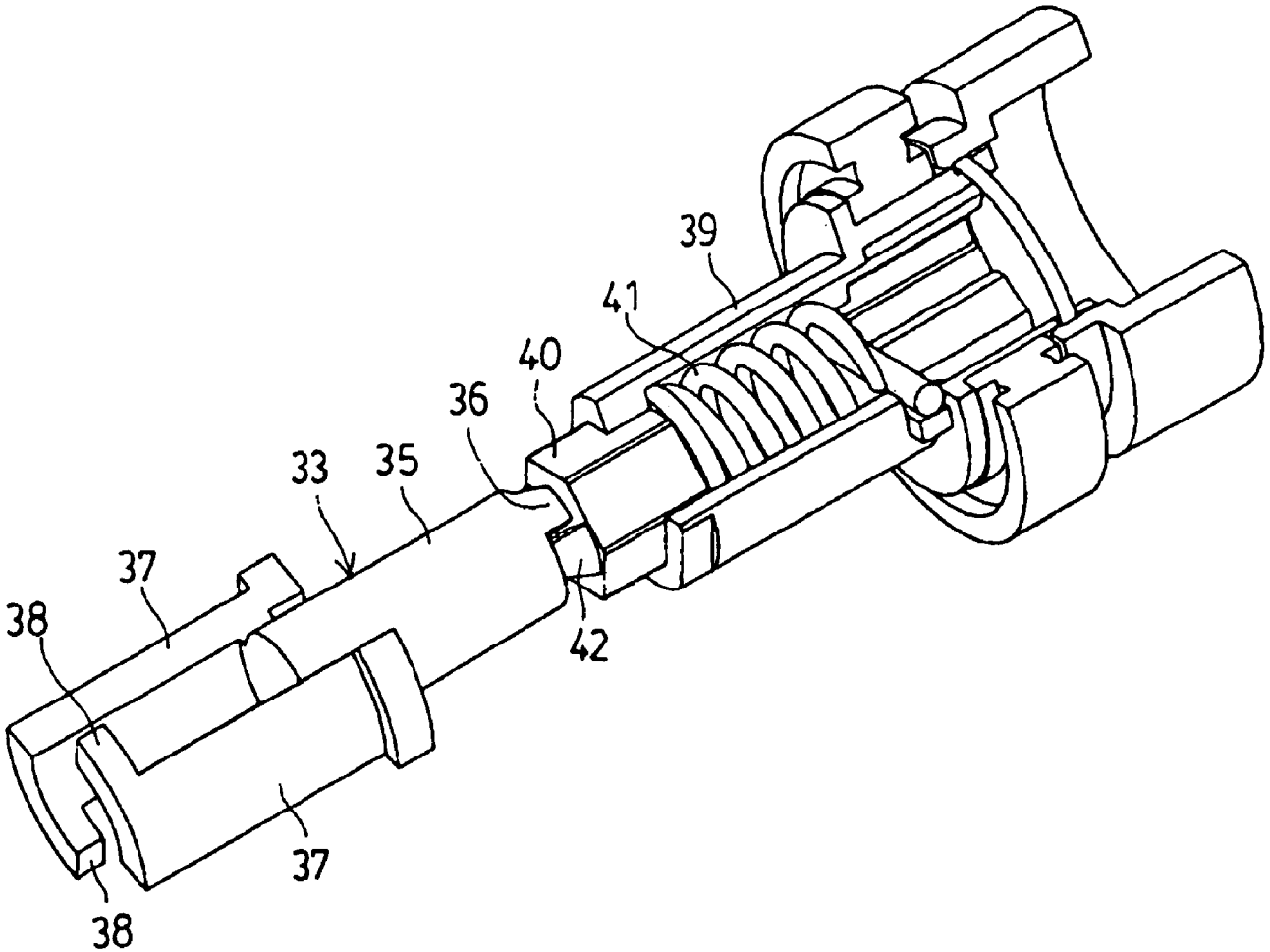
FIG. 3 is a perspective view of the twisting shaft and a one-way torque limiting mechanism.

As shown in FIG. 3, a clutch shaft 40 fitted lingitudinally slidably in a driving shaft 39 projects forward by a force of a compression coiled spring 41 contained in the driving shaft 39, and a clutch claw 42 formed on a front surface of the clutch shaft 40 is meshed with a clutch claw 36 of the twisting shaft 33. When the clutch shaft 40 is rotated clockwise, i.e., in the forward direction in a rear view (when viewed from the right side of the drawing), the surfaces at which the clutch claw 42 of the clutch shaft 40 and that 36 of the twisting shaft 33 are in contact with each other are vertical surfaces, and, when the clutch shaft 40 is rotated counter-clockwise, i.e., in the reverse direction, the surfaces at which these clutch claws are in contact with each other are inclined surfaces. Thus, a one-way torque limiting mechanism adapted to transmit a driving force to the twisting shaft 33 when the clutch shaft 40 is rotated forward, and to the twisting shaft 33 when the clutch shaft 40 is rotated reversely is formed. Owing to this arrangement, when the twisting shaft 33 is braked during the counter-clockwise, i.e. reverse rotation of the clutch shaft 40, the clutch shaft 40 compresses the compression coiled spring 41 and moves back due to a cam effect of the inclined surfaces of the clutches 36, 42, and the driving shaft 39 and clutch shaft 40 run idly.

Figure 4:
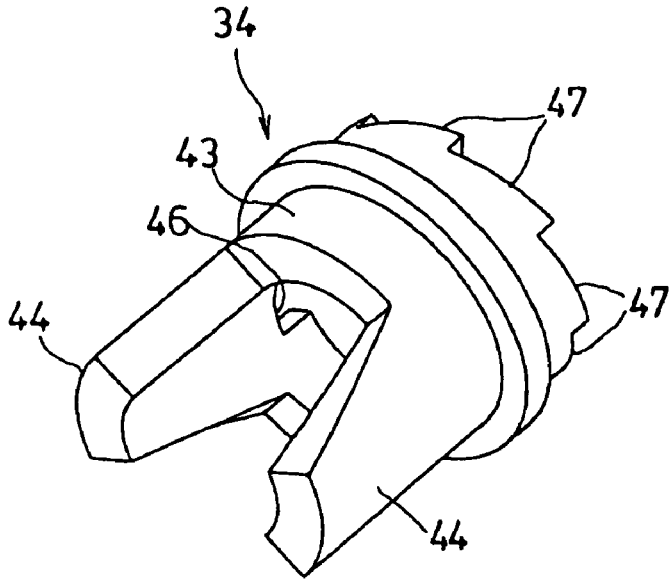
FIG. 4 is a perspective view of a remover.

FIG. 4 shows a remover 34 to be fitted around the twisting shaft 33, and the remover 34 is provided with a pair of forks 44 formed by subjecting a slitting process on a cylindrical shaft 43. These two forks 44 are in 180°-spaced rotationally symmetrical positions. The remover 34 is formed so that the front ends of the twisting shaft 33 and remover 34 become flush with each other when the twisting shaft 33 is inserted into the remover 34. As shown in FIG. 2, flanges 45 are formed at rear ends of the forks 37 of the twisting shaft 33, and engaged with the recesses 46 in an inner circumferential surface of a rear portion of the remover 34 shown in FIG. 4. The circumferential length of each recess 46 is set larger than that of each flange 45 so that the twisting shaft 33 and remover 34 can be rotated with respect to each other in a certain range of angle.

The remover 34 is provided on a rear end surface of the cylindrical shaft 43 thereof with a circumferentially extending ratchet 47, and the ratchet 47 and one-way stopper claw 48 fixed to the bearing 32 shown in FIG. 1 form a one-way stopper mechanism. When clockwise rotary torque in a rear view of the binding wire twisting apparatus 31 is exerted on the remover 34, the ratchet 47 pressed down the one-way stopper claw 48 to turn the same clockwise. When counter-clockwise rotary torque is exerted on the remover 34, the one-way stopper claw 48 is meshed with the ratchet 47, and the rotation of the remover 34 is prevented.

Figure 5:
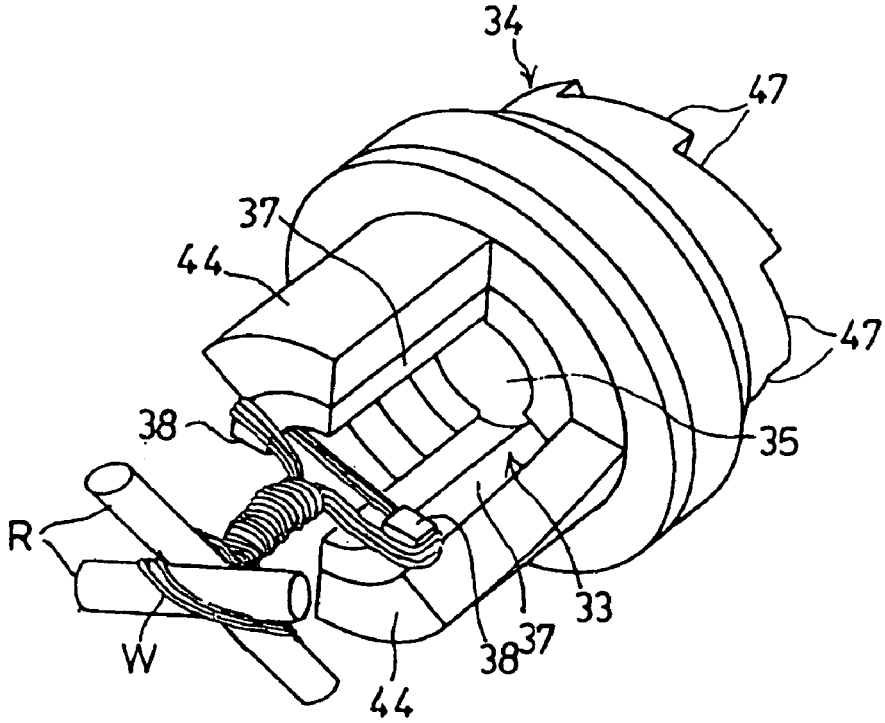
FIG. 5 is a perspective view of the binding wire twisting apparatus in a reinforcing bar binding condition.

A binding wire feed unit (not shown), which is similar to the unit described under the paragraph of the related art, is provided as shown in FIG. 1 in a position in which the binding wire W is passed between a pair of forks 37 of the twisting shaft 33 and formed into a loop. After the loop is formed, a twisting motor (not shown) is started, and the twisting shaft is rotated clockwise to cause the front end of the hook 38 to project forward in the rotational direction beyond the forks 44 of the remover 34. The flanges 45 mentioned above then impinge upon the portions of the wall surfaces of the recesses 46 of the remover 34 which are on the front side with respect to the rotational direction, and the twisting shaft 33 and remover 34 are rotated in one body. As a result, the loop of the binding wire W is twisted with the loop hung on the hooks 38 as shown in FIG. 5, and the reinforcing bar R are bound therewith.

Figure 6:
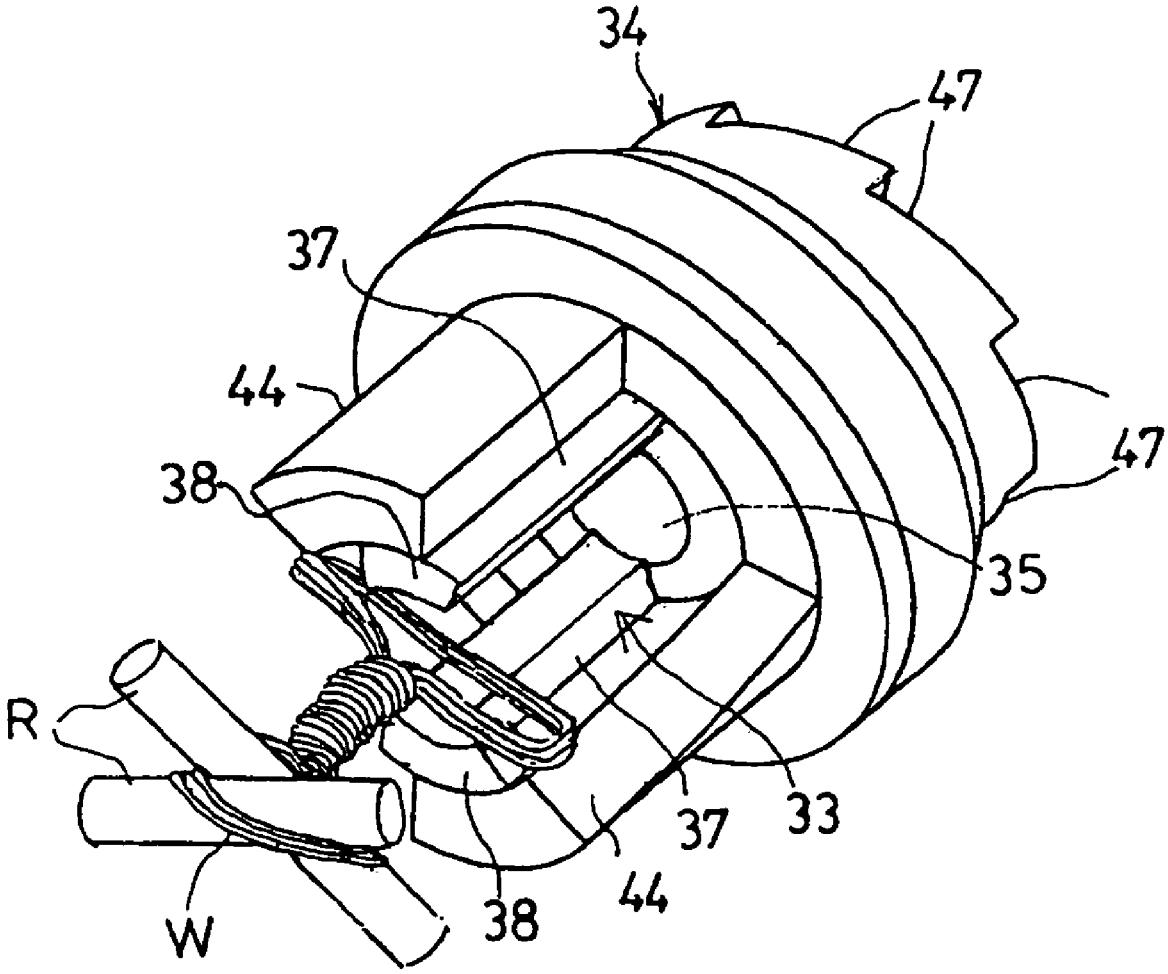
FIG. 6 is a perspective view of the binding wire twisting apparatus in a reinforcing bar-binding operation finished condition.
Figure 7:
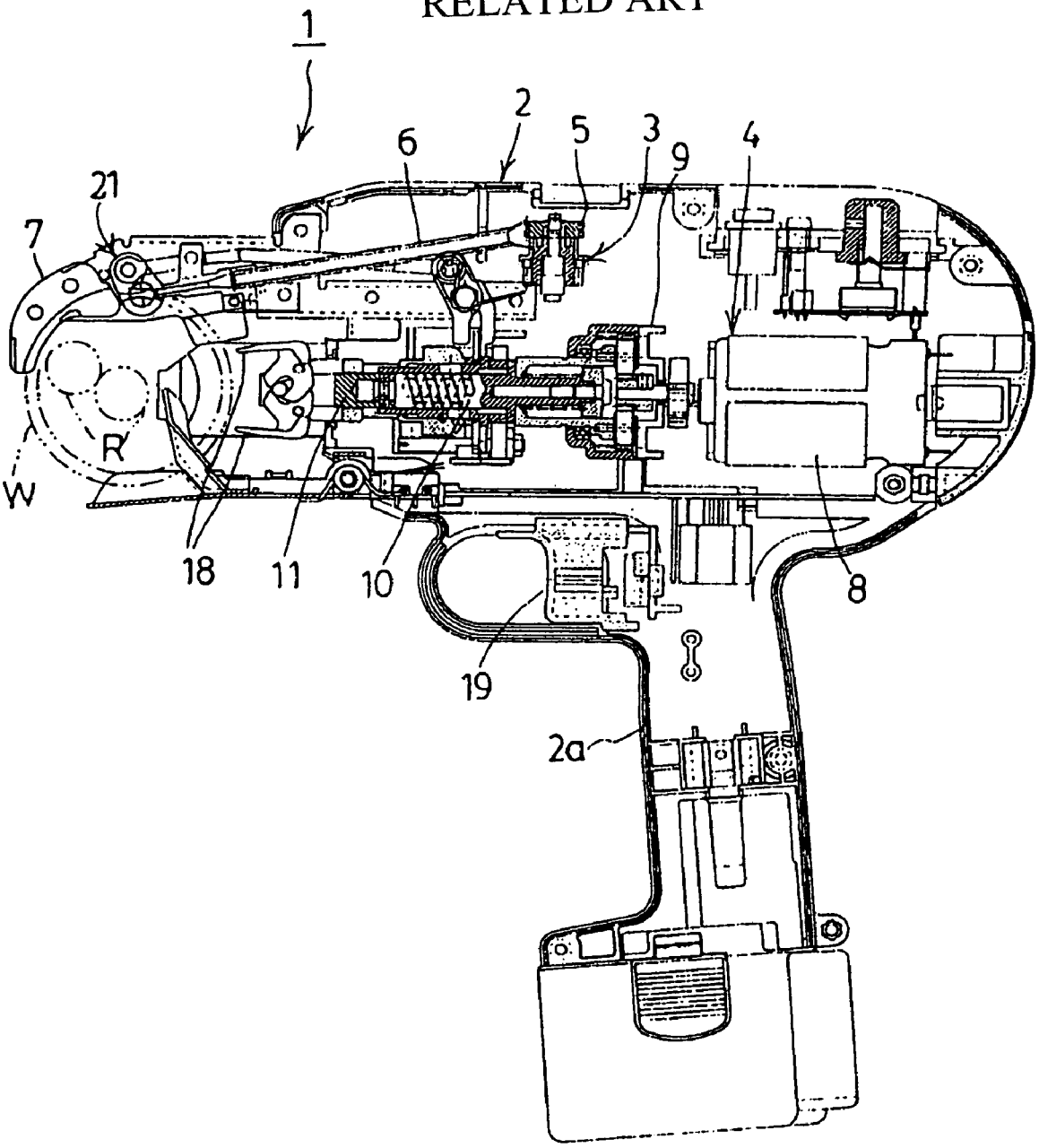
FIG. 7 RELATED ART
FIG. 7 shows a related art example, and is a sectioned side view of a reinforcing bar binding machine.
Figure 8A:
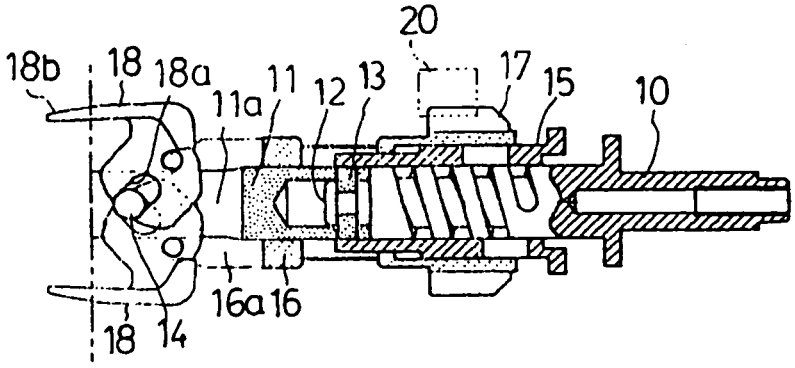
FIG. 8(a) RELATED ART
FIGS. 8(*a*) and 8(*b*) show a related art binding wire twisting apparatus, wherein FIG. 8(*a*) is a sectional view of the apparatus on standby, and FIG. 8(*b*) a sectional view of the apparatus in a binding wire gripping condition.
Figure 8B:
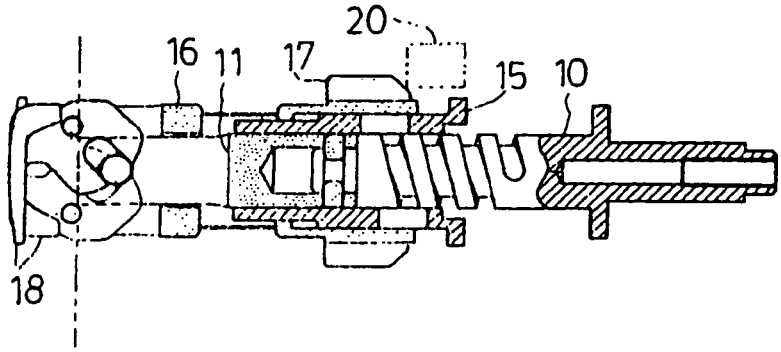
FIG. 8(b) RELATED ART

After the loop twisting operation is completed, the twisting motor is reversely rotated, so that the twisting shaft 33 and remover 34 are revesely rotated. The one-way stopper claw 48 shown in FIG. 1 is meshed with the ratchet 47 of the remover 34, and the rotation of the remover 34 is immediately stopped, the twisting shaft 33 only being reversely rotated. Consequently, the hooks 38 of the twisting shaft 33 hide themselves behind the inner surfaces of the forks 44 of the remover 34 as shown in FIG. 6, and the hung portions of the binding wire are pressed by side surfaces of the forks 44 and forcibly removed from the hooks 38. The flanges 45 of the twisting shaft 33 impinge upon the wall surfaces of the recesses 46 of the remover 34 to cause the rotation of the twisting shaft 33 to be also stopped, and the clutch shaft 40 of the one-way torque limiting mechanism shown in FIG. 3 runs idly as the clutch shaft 40 moves reciprocatingly in the longitudinal direction along the inclined surface of the clutch claw 36 of the twisting shaft 33. During this time, an increase in the driving current is detected by a stop control means to stop the twisting motor.

The stop control means for the motor may be formed so that the motor is stopped when a predetermined period of time elapses after the reverse rotation thereof is started. This means may also be formed by a combination of a time control operation and a current detection control operation. Various kinds of known torque limiting mechanisms, such as a ball clutch mechanism adapted to transmit torque by engaging a ball with a ball receiving hole by a spring can be applied to the one-way torque limiting mechanism, and the one-way torque limiting mechanism is not specially limited. In the above-described mode of embodiment, a hook-carrying twisting shaft and a fork-carrying sleeve (remover) are combined with each other, and the binding wire is removed from the hooks by the forks of the sleeve. The inner and outer positional relation between the hooks and forks maybe set contrary to that in the above embodiment, i.e., a structure in which the hooks are provided on the sleeve so as to remove the binding wire from the hooks by the forks provided on an inner shaft may also be employed. Namely, various kinds of modifications within the technical scope of the present invention can be made, and it is natural that the present invention includes such modifications.

The present invention is based on the invention disclosed in Japanese Patent Application (Japanese Patent Application No. 2001-330713) filed on Oct. 29, 2001, the content of which is taken as a reference in the specification of the present invention.

INDUSTRIAL APPLICABILITY

As described above, the binding wire twisting apparatus for reinforcing bar binding machines according to the present invention is formed by providing forks on the shaft and sleeve, and hooks on the shaft or forks of the sleeve, and adapted to carry out the twisting of the binding wire and the removing of the same from the twisting mechanism by rotating the shaft and sleeve forward and reversely. Therefore, the present invention is an invention having a simple structure, and advantages of the capability of reducing the number of parts and miniaturizing the apparatus.

The invention claimed is:

1. A binding wire twisting apparatus, for a reinforcing bar binding machine including a binding wire feed unit for feeding a binding wire along a loop guide and forming a loop of the binding wire and for twisting the loop of the binding wire, comprising:

a shaft including first forks at a front portion thereof;

a sleeve including second forks at a front portion thereof; and hooks, formed on front ends of the first forks, and the hooks bent in a forward rotational direction, wherein the shaft and the sleeve are forming a rotary pair, the loop of the binding wire is hung on the hooks and twisted by rotating the shaft and the sleeve in the sleeve in the forward rotational direction, and the binding wire engaged with the hooks is removed, by reversely rotating the shaft in relative to the sleeve after a completion of a twisting operation.

2. The binding wire twisting apparatus according to claim 1, wherein the shaft comprises a shaft portion, and the first forks projects forward from an outer circumferential surface of a front end portion of the shaft portion.

3. The binding wire twisting apparatus according to claim 2, wherein the shaft further comprises a clutch claw provided at a rear end section of the shaft portion thereof.

4. The binding wire twisting apparatus according to claim 3, wherein the clutch claw of the shaft includes:

a vertical surface, that contacts with a clutch claw provided on a clutch shaft engageable with the clutch claw of the shaft, when the shaft is rotated forward with respect to the clutch shaft, an inclined surface, that contacts with the clutch claw of the clutch shaft, when the shaft is reversely rotated with respect to the clutch shaft.

5. The binding wire twisting apparatus according to claim 1, wherein the sleeve is fitted around the shaft.

6. The binding wire twisting apparatus according to claim 1, wherein at least one of surfaces of the first forks and surfaces of the hooks is cylindrical.

7. The binding wire twisting apparatus according to claim 1, wherein the sleeve comprises a cylindrical shaft, the second forks are formed by a slitting process on the cylindrical shaft.

8. The binding wire twisting apparatus according to claim 7, wherein the sleeve further comprises a ratchet on a rear end surface of the cylindrical shaft, the ratchet and a one-way stopper claw fixed to a bearing for fitting the binding wire twisting apparatus constitute a one-way stopper mechanism.

9. The binding wire twisting apparatus according to claim 1, wherein front ends of the second forks and the front ends of the first forks are flush with each other, when the shaft is inserted in the sleeve.

10. The binding wire twisting apparatus according to claim 1, wherein the shaft comprises flanges at rear ends of the first forks, the sleeve comprises recesses engageable with the flanges in an inner circumferential surface of a rear portion thereof, and the circumferential length of each of the recesses is larger than length of each of the flanges.

11. The binding wire twisting apparatus according to claim 1, wherein the hooks are unmovably fixed to the first forks.

* * * * *